US006318309B1

(12) United States Patent
Burrahm et al.

(10) Patent No.: US 6,318,309 B1
(45) Date of Patent: Nov. 20, 2001

(54) OPPOSED PISTON ENGINE WITH RESERVE POWER CAPACITY

(75) Inventors: Robert Wayne Burrahm, San Antonio; John Craig Hedrick, Boerne, both of TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/726,895

(22) Filed: Nov. 30, 2000

(51) Int. Cl.[7] ..... F02B 25/08

(52) U.S. Cl. ..... 123/51 A; 123/51 B; 123/55.5

(58) Field of Search ..... 123/55.5, 55.7, 123/52.5, 53.4, 53.1, 55.2, 51 BC, 51 BB, 51 A, 51 AA, 51 AC, 51 B, 51 BA, 51 BD, 56 AC, 56 BB

(56) References Cited

U.S. PATENT DOCUMENTS

| | | | | |
|---|---|---|---|---|
| 639,686 | * | 12/1899 | Parks | 123/51 BC |
| 2,203,648 | | 6/1940 | Dons . | |
| 2,388,756 | | 11/1945 | Meyers . | |
| 2,532,106 | | 11/1950 | Korsgren . | |
| 2,910,973 | | 11/1959 | Witzky . | |
| 3,010,440 | | 11/1961 | Roth . | |
| 3,192,783 | | 7/1965 | Cruzan . | |
| 3,209,736 | | 10/1965 | Witzky . | |
| 3,608,530 | * | 9/1971 | Wenzel | 123/56 BB |
| 3,866,581 | | 2/1975 | Herbert . | |
| 5,025,759 | * | 6/1991 | Wenzel et al. | 123/56 AC |

OTHER PUBLICATIONS

J. Witzky R. Meriwether and F. Lux; "Piston–Turbine–Compound Engine–A Design and Performance Analysis" Society of Automotive Engineers International West Coast Meeting, pp. 1–11, NY, Argued 1965.

* cited by examiner

*Primary Examiner*—Marguerite McMahon
(74) *Attorney, Agent, or Firm*—Oliff & Berridge PLC

(57) ABSTRACT

Two pistons are reciprocatively disposed in each cylinder of an engine thereby forming combustion chambers at each end of the cylinder that operate in a four-stroke cycle, and a third combustion chamber formed between the pistons that selectively operates in a two-stroke mode. The combustion chambers at the ends of the cylinders have heads in which intake and exhaust valves are disposed, and the third chamber between the pair of pistons is ported to provide scavenged flow. The third chamber is not fueled and remains inactive except when maximum power is needed.

7 Claims, 2 Drawing Sheets

OPPOSED PISTON ENGINE WITH RESERVE POWER CAPACITY

BACKGROUND OF THE INVENTION

1. Technical Field

This invention relates generally to an internal combustion engine having two pistons disposed in a common cylinder, and more particularly to such an engine having three combustion chambers in each cylinder of the engine.

2. History of Related Art

Several arrangements have been proposed for internal combustion engines having two double-acting pistons mounted in a common cylinder. In this type of engine, a combustion chamber is provided between each piston and an adjacent cylinder head, and in some arrangements also between the two pistons, thereby providing three combustion chambers per cylinder.

For example, U.S. Pat. No. 2,203,648 issued Jun. 4, 1940 to F. C. Dons describes a two-stroke engine having three combustion chambers formed between, and at the outer ends, of two pistons disposed in a single cylinder. U.S. Pat. No. 2,388,756 granted Nov. 13, 1945 to W. G. Meyers likewise discloses an engine, operating in a two-stroke cycle, with double-acting pistons mounted in a common cylinder. U.S. Pat. No. 2,532,106, issued Nov. 28, 1950 to Theodore Korsgren also describes a two-stroke cycle opposed piston engine having three combustion chambers in each cylinder. Another example of an opposed piston engine, capable of operating in either a two or four-stroke cycle mode is described in U.S. Pat. No. 3,010,440 granted Nov. 28, 1961 to A. Roth.

All of the combustion chambers in each of the above-referenced engines operate contemporaneously in a common, i.e., the same, combustion mode using a predesignated fuel source. Thus, when optimizing engine performance, each of the above-referenced engines are limited to certain advantages provided by the particular operating cycle. For example, the four-stroke cycle has advantages in some operational areas over the two-stroke cycle, such as easier power regulation over wider variations in speed and load, cooler pistons, no fuel loss during exhaust, lower specific fuel consumption, and lower hydrocarbon emissions. The two-stroke cycle advantages, compared with four-cycle engines, include a 50% to 80% greater power output per unit piston displacement at the same speed and twice as many power impulses per crankshaft rotation.

The present invention is directed to overcoming one or more of the problems and limitations inherent in previous opposed piston engines.

SUMMARY OF THE INVENTION

In accord with one aspect of the present invention, an internal combustion engine, having at least one cylinder with spaced-apart ends, includes a cylinder head disposed at each of the spaced-apart ends of the cylinder, and a pair of pistons reciprocatively disposed in the cylinder. Each piston has a first end cooperating with one of the cylinder heads to form respective first and second combustion chambers adapted for operation in a four-stroke combustion mode, and a second end spaced from the respective first ends and cooperating with each other to form a third combustion chamber therebetween that is adapted for selective operation in a two-stroke combustion mode.

Other features of the internal combustion engine embodying the present invention include the reciprocating movement of each piston being selectively adjustable to provide a controllably variable compression ratio in the respective combustion chambers. Other features include each of the cylinder heads having at least one intake valve and at least one exhaust valve. Still an additional feature includes the third combustion chamber having at least one exhaust port and at least one intake port. Yet another feature of the internal combustion engine embodying the present invention includes the engine having a turbocharger in fluid communication with the first, second and third combustion chambers.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
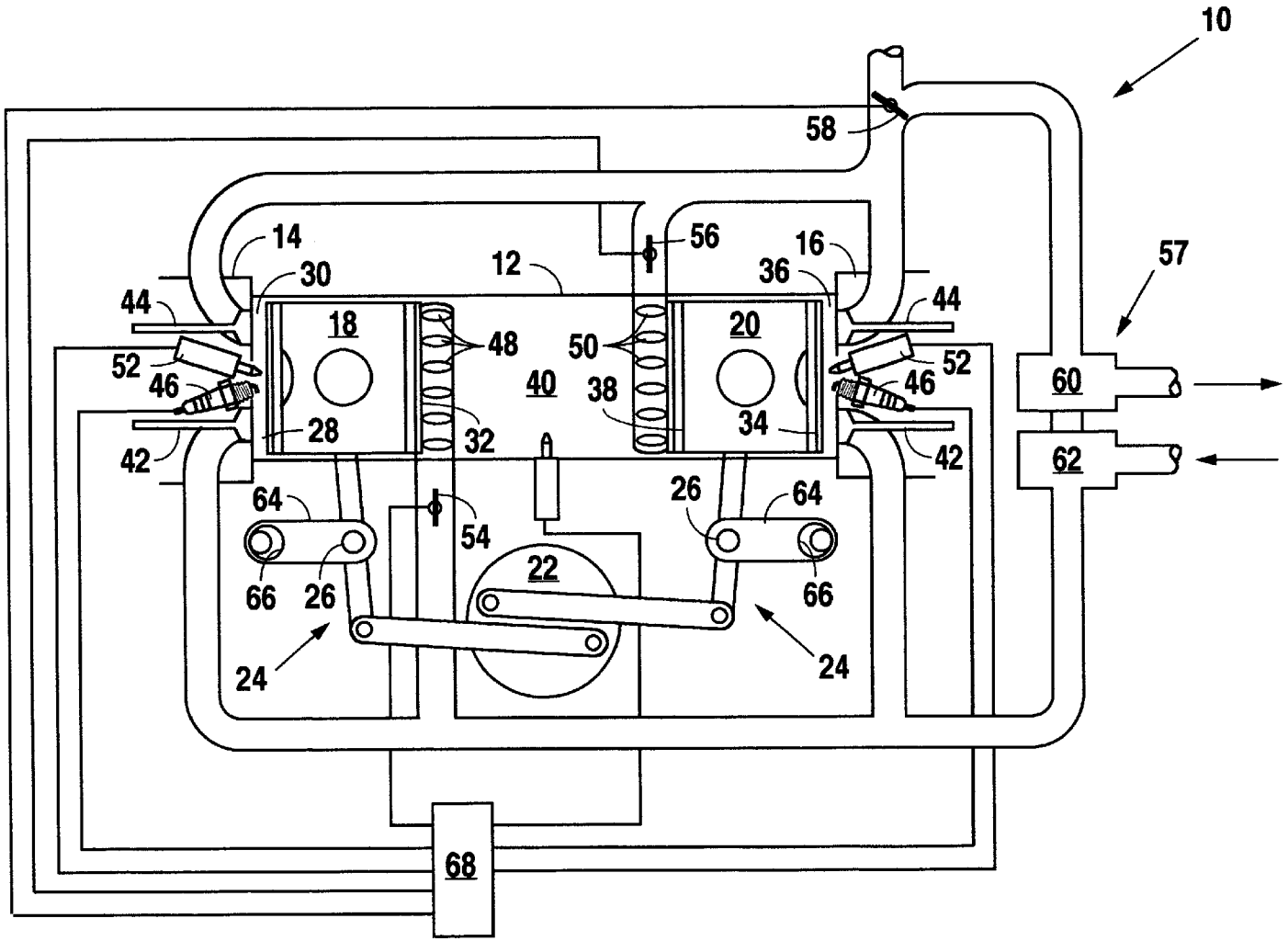
FIG. 1 is a schematic illustration of the opposed piston internal combustion engine embodying the present invention, showing the opposed pistons at their respective farthest apart positions.
Figure 2:
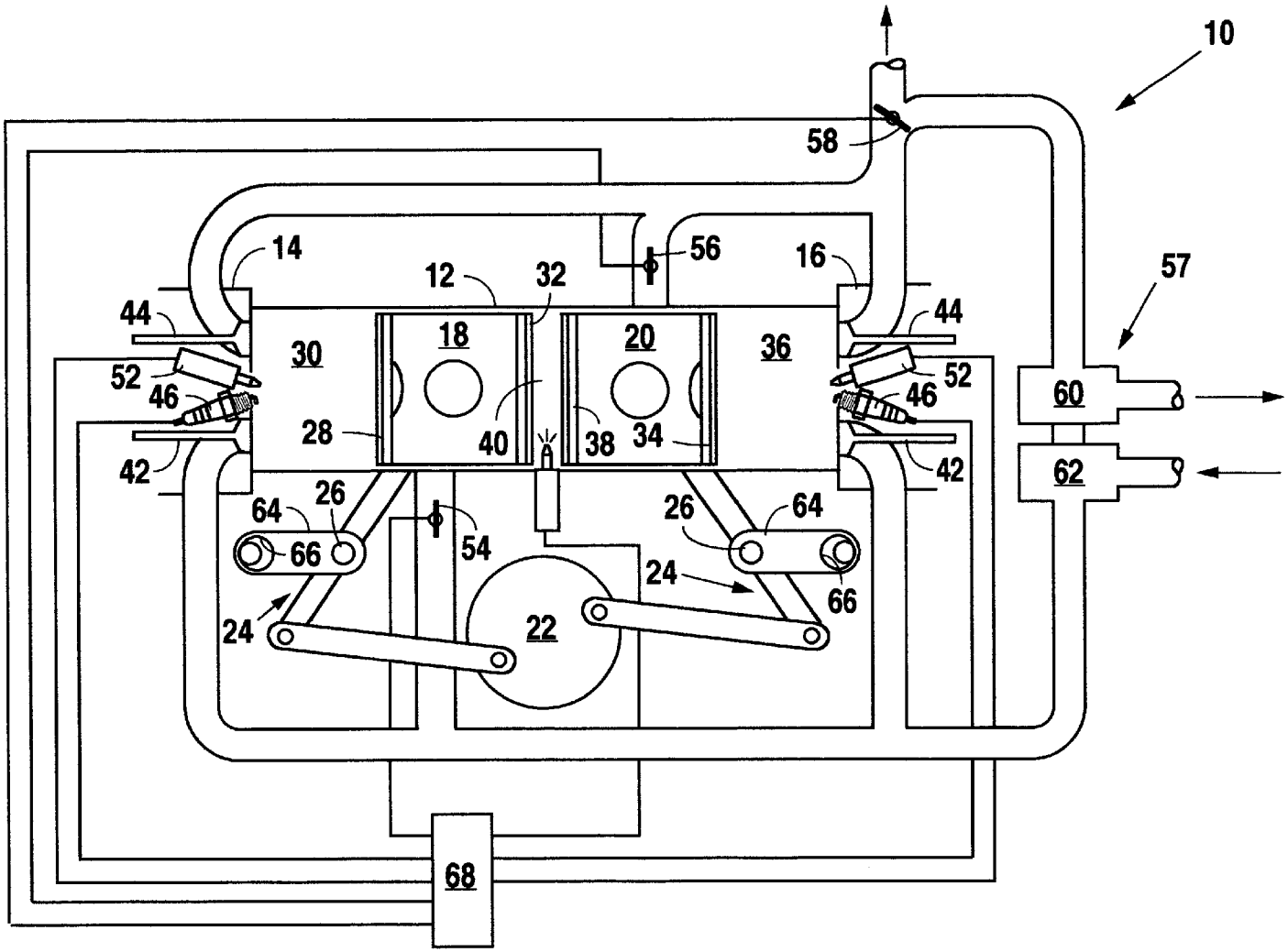
FIG. 2 is a schematic illustration of the opposed piston internal combustion engine embodying the present invention, showing the opposed pistons at their respective closest positions.

An opposed piston internal combustion engine embodying the present invention is illustrated schematically in FIGS. 1 and 2 and generally indicated by the reference numeral 10. The engine 10 has at least one, and preferably a plurality, of cylinders 12 with respective cylinder heads 14, 16 disposed at spaced-apart ends of the cylinder 12. A pair of pistons 18, 20 are reciprocatively disposed in each of the cylinders 12 and operatively connected to a crank shaft 22 by way of an articulated connecting linkage 24, one arm of which pivots about a fulcrum 26.

The first piston 18 has a first end 28 that cooperates with the cylinder head 14 to form a first combustion chamber 30 and a second end 32 spaced from the first end 28. In a similar manner, the second piston 20 has a first end 34 that cooperates with the adjacent cylinder head 16 to form a second combustion chamber 36, and a second end 38 spaced from the first end 34. The respective second ends 32, 38 of the first and second pistons 18, 20 cooperate with each other to form a third combustion chamber 40 therebetween. The first and second combustion chambers 30, 36 each have at least one intake valve 42 and at least one exhaust valve 44 in communication with the respective combustion chamber 30, 36, thereby providing appropriate valve action to enable the first and second combustion chambers 30, 36 to operate in a four-stroke combustion cycle.

As described below in greater detail, the opposed internal combustion engine 10 embodying the present invention is capable of operating on a wide variety of fuels. When operating on spark-ignited fuels, such as gasoline, each of the combustion chambers 30, 36 are provided with a spark plug 46. When operating on a fuel, such as diesel fuel, capable of auto-ignition, the spark plug 46 may be replaced with a glow plug, if so desired. Importantly, the third combustion chamber 40 has a plurality of radially disposed intake ports 48 and exhaust ports 50 that provide piston-controlled ported flow through the combustion chamber 40, thereby selectively enabling scavenged two-stroke combustion in the third combustion chamber 40 when additional power is needed. In a similar manner, as the first and second combustion chambers 30, 36, if operating on a spark-ignited fuel, the third combustion chamber also includes a spark plug 46, or if so desired, a glow plug for auto-ignition fuels.

Preferably, fuel is injected into each of the combustion chambers 30, 36 and 40 by way of a fuel injector 52 in fluid communication with each of the combustion chambers. Alternatively, an air/fuel mixture may be introduced into the first and second combustion chambers 30, 36 through the respective intake valves 42, and when desired for extra power, into the third combustion chamber 40 through the intake ports 48. Intake air, or an air/fuel mixture, flow into the third combustion chamber, through the intake ports 48 is controlled by an intake port control valve 54. Exhaust flow from the third combustion chamber 40 is controlled by an exhaust port control valve 56.

In some embodiments, it may be desirable to provide an exhaust gas driven turbocharger 57 to provide added boost pressure to the intake air flow. When so arranged, the engine 10 embodying the present invention has an exhaust gas flow control valve 58 disposed in the exhaust manifold between the exhaust valves 44 and the exhaust ports 50, and a turbine section 60 of the turbocharger 57, which drives a compressor section 62 of the turbocharger 57.

Desirably, the opposed piston internal combustion engine 10 embodying the present invention has a selectively variable compression ratio which enables the engine 10 to operate over a wide load range on a variety of fuels. To enable the selective variable adjustment of the reciprocating movement of the pistons 18, 20 within the cylinder 12, the position of the fulcrum 26 of the linkage 24 between the respective pistons 18, 20 and the crankshaft 22 is adjustable. Examples of adjustable fulcrums in linkage between pistons and crankshaft is described in U.S. Pat. Nos. 2,910,973 and 3,209,736, both issued to Julius E. Witzky. In the preferred embodiment of the internal combustion engine 10 embodying the present invention, the position of the fulcrum 26 is controlled by a link 64 that has one end attached to the fulcrum 26 and a second end mounted in an eccentric bushing 66 in a manner similar to that described in the above-referenced Witzky patents.

Operation of the intake port control valve 54, the exhaust port control valve 56, and the exhaust gas flow control valve 58 is controlled by a conventional electronic engine control unit (ECU) 68 which also controls, in a conventional manner, fuel injection through injectors 52 and operation of either a spark plug 46 or glow plug, is so equipped. In a similar manner, the engine control unit 68 may be programmed to control the rotation of the eccentric bushings 66 to vary the stroke of the pistons 18, 20 and consequently, the compression ratio in the combustion chambers 30, 36, 40. Importantly, fuel injection to the third combustion chamber 40 is selectively controlled by the ECU 68 to inject fuel only when needed for additional power from the engine 10. Thus, the third combustion chamber 40 is not fueled and remains inactive except when maximum power is needed.

INDUSTRIAL APPLICABILITY

The opposed piston internal combustion engine 10 embodying the present invention is particularly useful in vehicles that may require added emergency power to augment the baseline engine power. Examples of such vehicles are commonly found in military applications powered by internal combustion engines, and are generally large fuel users. The Department of Defense is interested in reducing fuel consumption for obvious logistical reasons, and is also desirous of reducing exhaust emissions to meet ever increasing Environment Protection Agency standards. Thus, it is desirable that military vehicles not only have optimum fuel consumption and low exhaust emissions, for normal non-combat operations, but they must also be capable of meeting tactical battlefield requirements. In battle, neither exhaust emissions or short-term fuel consumption are important by comparison to the mission at hand.

The opposed piston internal combustion engine 10 embodying the present invention provides a vehicle engine that meets applicable emission standards during peacetime exercises and routine use with improved fuel economy over existing comparable-size engines, while still having the capability to produce high power requirements when needed. This important dual function is accomplished by the opposed piston internal combustion engine embodying the present invention and illustrated in FIGS. 1 and 2. With reference to the drawings, the pistons 18, 20 form respective first and second combustion chambers 30, 36 in cooperation with cylinder heads 14 and 16. The cylinder heads 14, 16 contain typical engine valves 48, 50 and fuel injectors 52. This arrangement provides combustion chambers 30, 36 at the outboard ends of the cylinder 12 that operate in a four-stroke combustion cycle, thus providing the inherent advantages of four-stroke cycles such as good fuel economy and low emissions. In particular, when operating on an auto-ignition fuel, such as diesel fuel, the first and second combustion chambers 30, 36 function as a typical direct injection diesel four-stroke engine.

Importantly, the second ends 32, 38 of the pistons 18, 20 also form a single combustion chamber 40. This portion of the engine 10 functions as a flow-through scavenged two-cycle engine and is fueled only when maximum power is desired. The two-stroke portion of the engine is desirably optimized for maximum power and may not meet emissions standards when operating in emergency mode. Since the two-stroke cycle provides a power stroke during each rotation of the crankshaft, the power output of the engine is dramatically increased.

The variable compression ratio feature, controlled by the position of the fulcrum 26 of the linkage 24 between the pistons 18, 20, and the crankshaft 22, permits use of a wide variety of fuels, which may be extremely important in battlefield situations where a selectable variety of fuels may be limited or non-existent. Also, if so desired, the turbocharger 57, comprising the turbine stage 60 and the compressor stage 62 may have variably controlled geometry to manage induction air and cylinder filling under a variety of operating conditions. Although not shown in the figure, control over the variable geometry turbocharger can be carried out by the ECU 68.

Although the present invention is described in terms of preferred exemplary embodiments, with specific illustrative alternative arrangements for either auto-ignition or spark ignition operation, with or without turbocharging and/or variable compression ratios, those skilled in the art will recognize that changes in those arrangements may be made without departing from the spirit of the invention. Such changes are intended to fall within the scope of the following claims. Other aspects, features and advantages of the present invention may be obtained from a study of this disclosure and the drawings, along with the appended claims.

What we claim is:

1. An internal combustion engine having at least one cylinder with spaced-apart ends, said engine comprising:

a cylinder head disposed at each of the spaced-apart ends of the cylinder;

a pair of pistons reciprocatively disposed in said cylinder and operatively connected to a crankshaft, each piston of said pair of pistons having a first end cooperating with one of the cylinder heads to form respective first and second combustion chambers adapted for operation in a four-stroke combustion mode, and a second end spaced from the respective first end and cooperating with each other to form a third combustion chamber therebetween adapted for selective operation in a two-stroke combustion mode.

2. The internal combustion engine, set forth in claim 1, wherein the reciprocating movement of each piston of said pair of pistons is selectively adjustable to provide a controllably variable compression ratio in each of the respective combustion chambers.

3. The internal combustion engine, set forth in claim 1, wherein each of the cylinder heads disposed at the spaced apart ends of the cylinder has at least one intake valve and, at least one exhaust valve.

4. The internal combustion engine, set forth in claim 1, wherein said third combustion chamber has at least one exhaust port and at least one intake port in direct communication therewith.

5. The internal combustion engine, as set forth in claim 1, wherein each of the combustion chambers of said engine have a spark plug in respective communication therewith.

6. The internal combustion engine, as set forth in claim 1, wherein each of the combustion chambers of said engine have a glow plug in respective communication therewith.

7. The internal combustion engine, as set forth in claim 1, wherein said engine includes a turbocharger in fluid communication with said first, second and third combustion chambers.

* * * * *